US010577773B2

(12) United States Patent
Kanemitsu

(10) Patent No.: US 10,577,773 B2
(45) Date of Patent: Mar. 3, 2020

(54) CONSTRUCTION METHOD

(71) Applicant: Waseda House Co., Matsudo (JP)

(72) Inventor: Youtoku Kanemitsu, Matsudo (JP)

(73) Assignee: Waseda House Co., Matsudo (JP)

( * ) Notice: Subject to any disclaimer, the term of this patent is extended or adjusted under 35 U.S.C. 154(b) by 109 days.

(21) Appl. No.: 15/827,115

(22) Filed: Nov. 30, 2017

(65) Prior Publication Data

US 2018/0258605 A1 Sep. 13, 2018

(30) Foreign Application Priority Data

Mar. 8, 2017 (JP) ..... 2017-043855

(51) Int. Cl.

| | |
|---|---|
| ***E02D 31/02*** | (2006.01) |
| ***E04H 9/16*** | (2006.01) |
| ***B44D 5/00*** | (2006.01) |
| ***E02D 31/00*** | (2006.01) |

(52) U.S. Cl.

CPC ..... *E02D 31/02* (2013.01); *B44D 5/00* (2013.01); *E02D 31/008* (2013.01); *E04H 9/16* (2013.01)

(58) Field of Classification Search

CPC ..... B44D 5/00; E02D 31/008; E02D 31/02; E04H 9/16

USPC ..... 427/421.1

See application file for complete search history.

(56) References Cited

U.S. PATENT DOCUMENTS

| | | | | |
|---|---|---|---|---|
| 2004/0040227 | A1* | 3/2004 | Tozaka | E04B 1/72 52/169.14 |
| 2007/0050903 | A1* | 3/2007 | Sappenfield | A61H 33/06 4/524 |
| 2007/0089229 | A1* | 4/2007 | Yatomi | A61H 33/063 4/524 |

FOREIGN PATENT DOCUMENTS

| | | |
|---|---|---|
| JP | 2003-089770 | 3/2003 |
| JP | 2003-268290 | 9/2003 |
| JP | 2005-139571 A | 6/2005 |
| JP | 2008-013734 | 1/2008 |
| JP | 3155690 | 11/2009 |
| JP | 2010-248834 | 11/2010 |
| JP | 3165833 | 2/2011 |
| JP | 2014-037341 | 2/2014 |

OTHER PUBLICATIONS

Japanese Office Action dated Mar. 20, 2018, of corresponding Japanese Application No. 2017-043855, along with an English translation.

(Continued)

*Primary Examiner* — Alexander M Weddle
(74) *Attorney, Agent, or Firm* — DLA Piper LLP (US)

(57) ABSTRACT

A construction method includes a charcoal paint application step in which a charcoal paint is applied to at least one of a floor, a wall, and a ceiling within a construction target room; an arrangement step in which flooring members made of Obi-sugi are arranged on the floor of the room; a diatomaceous earth application step in which diatomaceous earth is applied to the wall of the room; and a spraying step in which an antioxidant aqueous solution is sprayed on at least one of the floor on which the flooring members are arranged, the wall to which the diatomaceous earth is applied and the ceiling to which the charcoal paint is applied.

14 Claims, 4 Drawing Sheets

(56) References Cited

OTHER PUBLICATIONS

Japanese Office Action dated Jul. 17, 2018, of counterpart Japanese Application No. 2017-043855, along with an English translation.
Decision of Refusal dated Oct. 2, 2018, of counterpart Japanese Application No. 2017-043855, along with an English translation.

* cited by examiner

CONSTRUCTION METHOD

TECHNICAL FIELD

This disclosure relates to a construction method through which a space such as a living room and a bedroom is constructed.

BACKGROUND

Sick building syndrome which is a physical disorder caused by chemical substances used as building materials, mold and the like is a problem. However, when residents have purchased a house or are living in a house, it is not easy for them to move from the house or sell the house.

As a countermeasure against such a sick house, development of a wall member and the like to prevent diffusion of volatile organic compounds after construction has progressed (for example, see Japanese Unexamined Patent Application Publication No. 2005-139571).

However, in Japanese Unexamined Patent Application Publication No. 2005-139571, diffusion of organic compounds is merely prevented, and improvement in the environment in spaces such as a living room and a bedroom is expected to be unlikely. That is, in addition to chemical substances, there are various conditions that influence the environment in spaces such as a living room and a bedroom. For example, residents and others can stay comfortably in a space when the humidity is optimal and there are no unpleasant odors.

As described above, when construction is performed by a known construction method, it is difficult to provide a comfortable environment for residents. It could therefore be helpful to provide a construction method through which a comfortable environment is provided for residents.

SUMMARY

I thus provide:

A construction method including a charcoal paint application step in which a charcoal paint is applied to at least one of a floor, a wall, and a ceiling within a construction target room; an arrangement step in which flooring members made of Obi-sugi are arranged on the floor of the room; a diatomaceous earth application step in which diatomaceous earth is applied to the wall of the room; and a spraying step in which an antioxidant aqueous solution is sprayed on at least one of the floor on which the flooring members are arranged, the wall to which the diatomaceous earth is applied and the ceiling to which the charcoal paint is applied.

In the construction method, it is possible to provide a comfortable environment for residents.

EXPLANATION OF REFERENCES

Figure 1:
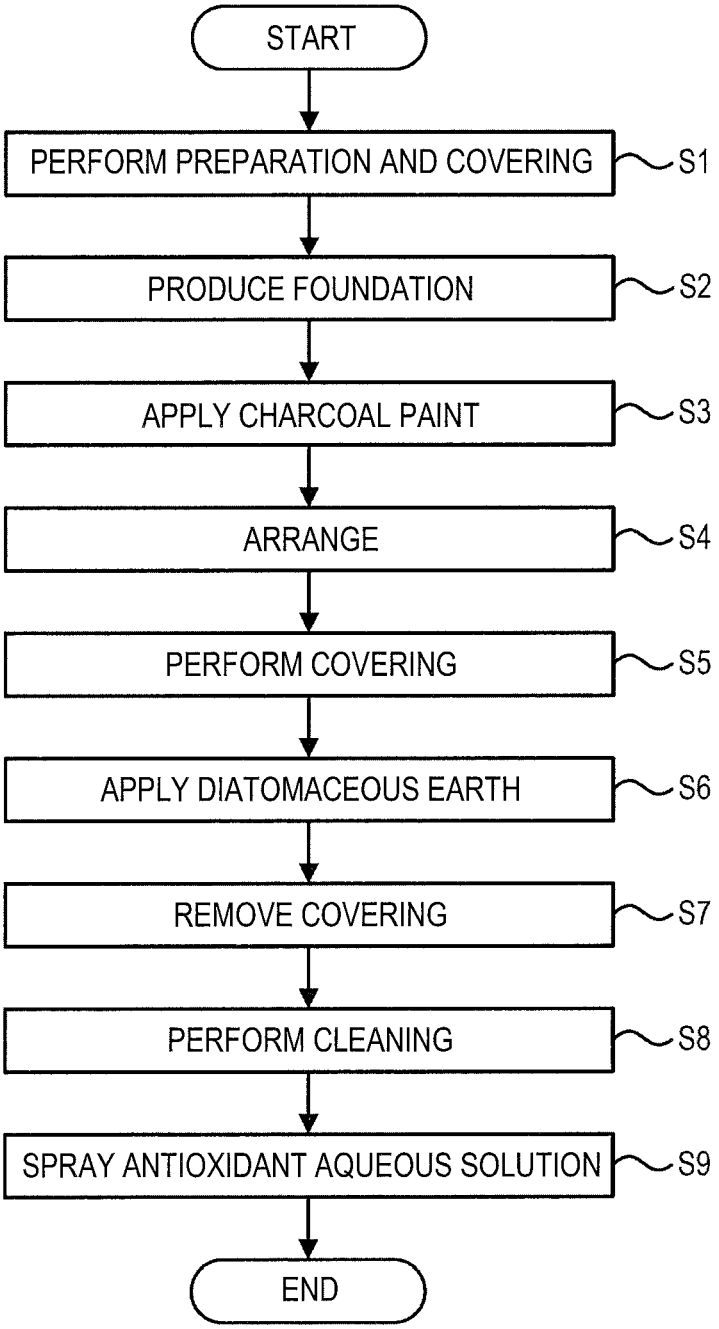
FIG. 1 is a flowchart describing a construction method according to an example.

101 floor having structure according to various construction methods
102 wall having structure according to various construction methods
103 plywood
104 flooring member
104*a*, 104*b* end
105 gypsum board
106 baseboard
107 diatomaceous earth
108 charcoal paint
109 wedge
110 nail

DETAILED DESCRIPTION

A construction method according to an example will be described below with reference to the drawings. When construction is performed by the construction method according to the example, it is possible to provide a comfortable environment for residents.

The construction method according to the example includes a "charcoal paint application step" in which a charcoal paint is applied to at least one of a floor, a wall, and a ceiling within a construction target room, an "arrangement step" in which flooring members made of Obi-sugi are arranged on the floor of the room, a "diatomaceous earth application step" in which diatomaceous earth is applied to the wall of the room, and a "spraying step" in which an antioxidant aqueous solution is sprayed on at least one of the floor on which the flooring members are arranged, the wall to which the diatomaceous earth is applied and the ceiling to which the charcoal paint is applied.

As shown in the flowchart in FIG. 1, when construction is performed by the construction method according to the example, first, preparation and covering are performed (S1). Specifically, in preparation, members such as flooring members used in an arrangement step (S4) to be described below are unpacked, and left for about a week to adjust to a construction target environment. In covering, protection is performed to prevent a window, a doorknob and the like to which a charcoal paint need not be applied, from becoming dirty. In addition, when an air conditioner and the like are installed, it is necessary to temporarily remove the air conditioner and the like.

Next, a foundation of a target space is produced (S2). For example, foundations for a floor, a wall, and a ceiling are produced. The foundation production will be described in detail later.

Next, a charcoal paint is applied to the target space (S3). For example, a charcoal paint is applied to the floor, the wall, and the ceiling. In this case, for example, the charcoal paint is applied to the floor once, applied to the wall once, and applied to the ceiling twice. Since the floor and the wall become the foundation, the charcoal paint is applied once. However, since the ceiling is a finish, the charcoal paint is applied twice so that color unevenness does not occur. Components of the charcoal paint used here will be described in detail later.

After the charcoal paint is applied, flooring members are arranged on the surface of the floor (S4). Components of the flooring members used here and an arrangement of flooring members will be described in detail later.

After the flooring members are arranged, covering is performed (S5). Specifically, the flooring members arranged in Step S4 are covered. In this case, a covering sheet is preferably raised 200 mm or more up the wall. Thus, it is possible to prevent the occurrence of marks on the flooring member and the sheet from being turned over. In addition, care needs to be taken that a covering tape is not directly attached to the flooring members.

Next, diatomaceous earth is applied to the target space (S6). Components of the diatomaceous earth used here will be described in detail later.

After the diatomaceous earth is applied, covering applied in Steps S1 and S5 is removed (S7). In addition, after the covering is removed, a target room is cleaned (S8). When sufficient cleaning is performed here, sufficient effects when spraying an antioxidant aqueous solution to be performed next can be obtained. However, if insufficient cleaning is performed, the effects of spraying an antioxidant aqueous solution are reduced.

Finally, an antioxidant aqueous solution is sprayed to the target space (S9). Components of the antioxidant aqueous solution used here and a spraying method will be described in detail later. In this manner, in the constructed room, it is possible to obtain an air purification effect, a chemical substance removal effect, a deodorizing and air freshening effect, a humidity control effect, an antibacterial and antifungal effect, an insulation effect, a flameproof effect, a relaxing effect and the like.

Production of a foundation during construction will be described. First, a foundation of a floor is produced in procedures of (A1) to (A2), a foundation of a wall is produced in procedures of (A3) to (A5), and a foundation of a ceiling is produced in procedures of (A6) to (A8). When remodeling is performed, (A9) is performed before the procedures of (A1) to (A8).

(A1) According to various construction methods, a floor to be constructed is changed to a floor having an appropriate structure. To prevent cracks and warping, dried wood is used as a member and given a flat finish.

(A2) Plywood to which a "charcoal paint" is to be applied is attached. As the plywood, F Forster-certified plywood with a size of 12 mm or more is used.

(A3) According to various construction methods, a wall to be constructed is changed to a wall having an appropriate structure. To prevent cracks and warping, dried wood is used as a member and given a flat finish.

(A4) A gypsum board is attached to apply a "charcoal paint."

(A5) Surfaces of a connector and a screw fixing part are smoothed with a putty treatment.

(A6) According to various construction methods, a ceiling to be constructed is changed to a ceiling having an appropriate structure. To prevent cracks and warping, dried wood is used as a member and given a flat finish.

(A7) A gypsum board is attached to apply a "charcoal paint."

(A8) Surfaces of a connector and a screw fixing part are smoothed with a putty treatment.

(A9) When remodeling is performed, unevenness adjustment is performed on the existing floor, existing walls, and existing ceiling, the number of nails and screws driven in increases, and an adhesive is injected. Unevenness adjustment means that a smooth surface is formed (smoothed) with an appropriate member.

After the foundations are produced, the foundations of the floor, the walls, and the ceiling are cleaned. It is necessary to sufficiently dry the foundations.

Components of Charcoal Paint

The charcoal paint includes red pine tree charcoal. The red pine tree charcoal is porous and contaminants (such as formaldehyde, ammonia, and toluene) in the air can be adsorbed in a plurality of fine pores. In addition, it is also effective in absorbing fine contaminants such as particulate substances termed PM 2.5. Therefore, when the charcoal paint including red pine tree charcoal is used, it is possible to purify indoor air.

The red pine tree charcoal has a honeycomb pore structure and stronger adsorption power than other pore structures. Furthermore, since the red pine tree charcoal has mesopores, it adsorbs and releases moisture. Therefore, when the charcoal paint including red pine tree charcoal is used, it is possible to control the humidity in the room. When the humidity is controlled, it is possible to prevent mold from growing in the room. In addition, when the humidity is controlled, it is possible to prevent the occurrence of condensation. Mold causes asthma. Therefore, preventing growth of mold is important to prevent asthma.

It is preferable that the charcoal paint include two types of red pine tree charcoal burned at different temperatures. This is because a carbide is either acidic or alkaline depending on a temperature at which a tree is burned. Thus, when both acid charcoal and alkaline charcoal are used, it is possible to obtain different deodorant effects and a strong deodorant effect. Specifically, in the charcoal paint, red pine tree charcoal (high temperature charcoal) burned at about 900° C. and red pine tree charcoal (low temperature charcoal) burned at about 500° C. are used.

High temperature charcoal and low temperature charcoal of the red pine tree charcoal are made into fine particles with a size of about 8 to 10 μm and treated with a solvent. In this case, the solvent used is preferably, for example, a natural material derived from nature. In addition, a temperature range for high temperature charcoal and low temperature charcoal is preferably about 500 to 900° C.

Since charcoal releases far infrared rays (10 to 14 μm), when red pine tree charcoal is used, negative ions are generated. Thus, it is possible to make the indoor environment comfortable.

In addition, the charcoal paint may include any of bamboo charcoal, a high carbon ceramic, and an antibacterial agent.

The bamboo charcoal has an air purification effect, a humidity control effect, a deodorant effect and the like. Thus, when bamboo charcoal particles are used together with red pine tree charcoal particles, it is possible to realize air purification, humidity control, and deodorization of the room.

As the high carbon ceramic, a carbon ceramic having a carbon content of 99% or more is used. The high carbon ceramic performs transmission at a healthy frequency (about 2.5 Hz) included in a healthy range (0 to 9.5 Hz). Thus, it is possible to obtain a relaxing effect.

As the antibacterial agent, for example, a silver-based inorganic antibacterial agent can be used. Thus, it is possible to prevent bacteria from growing in a place to which the charcoal paint is applied. For example, it is possible to prevent bacteria such as *Staphylococcus aureus* or *E. coli* from multiplying.

Components of Flooring Member

As the flooring member, Obi-sugi is used. Obi-sugi has a strong deodorant effect and humidity control effect. Thus, it is possible to realize deodorization and humidity control in the room. In addition, cedar has a strong heat insulating property due to air in a plurality of voids in cells. Therefore, when Obi-sugi is used, it is possible to insulate the room. Moreover, Obi-sugi is softer than other coniferous trees. Thus, when Obi-sugi is used as the flooring member, it is possible for residents living in the room to be less tense and more relaxed, and it is safe when a child falls because the flooring member is gentle on the legs. In addition, since Obi-sugi includes resin that termites do not like, it serves as a termite preventing member. In addition, since Obi-sugi is a light wood, an operator can easily handle it.

As the flooring member, Obi-sugi dried to have a moisture content of 15% or less is used. Thus, it is possible to prevent deformation and the like after the flooring member is constructed.

Arrangement of Flooring Members

Figure 2:
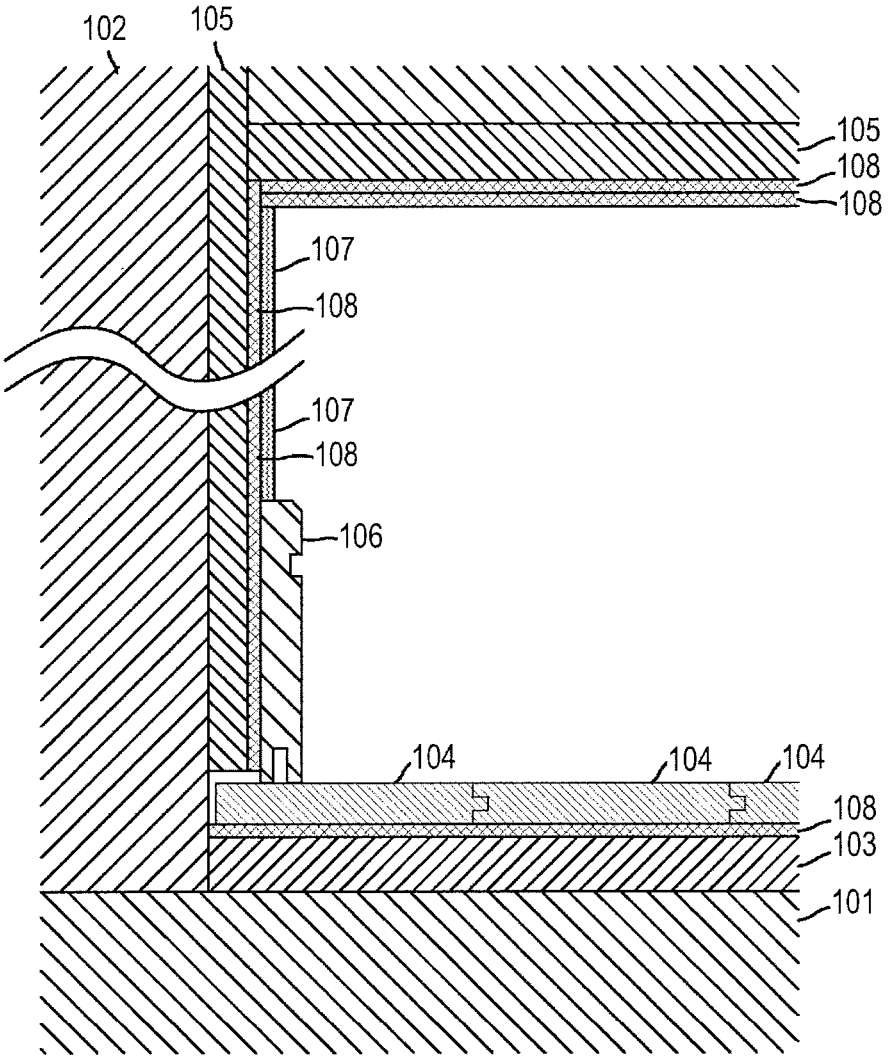
FIG. 2 is a sectional view showing a state in which construction is performed by the construction method according to the example.
Figure 3:
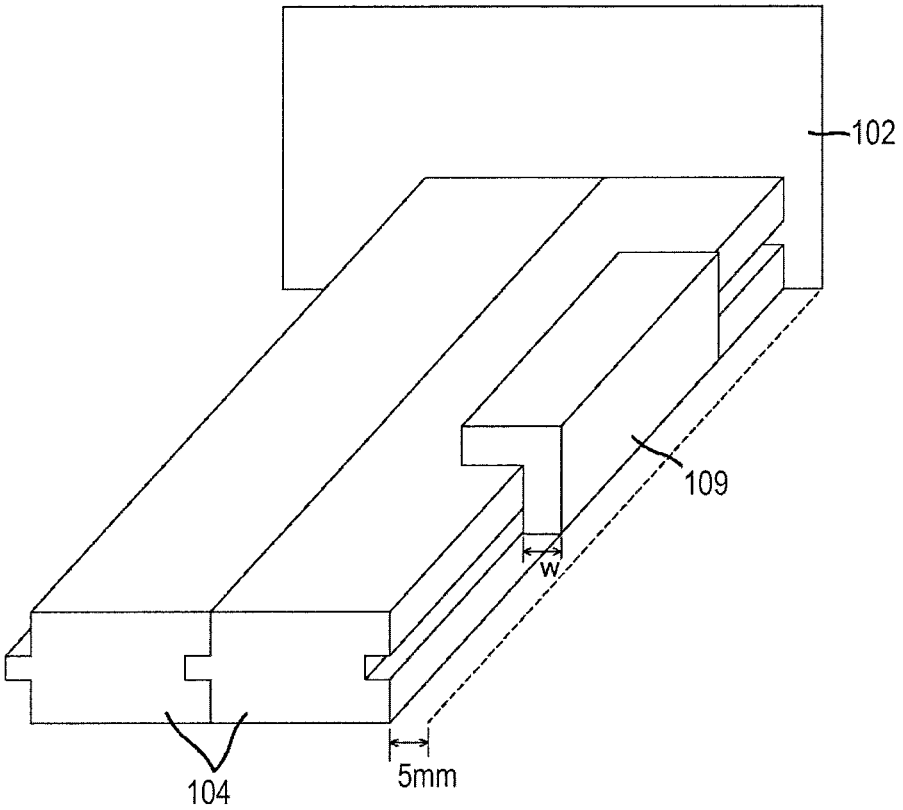
FIG. 3 is an explanatory diagram showing a step of arranging flooring members in the construction method according to the example.
Figure 4:
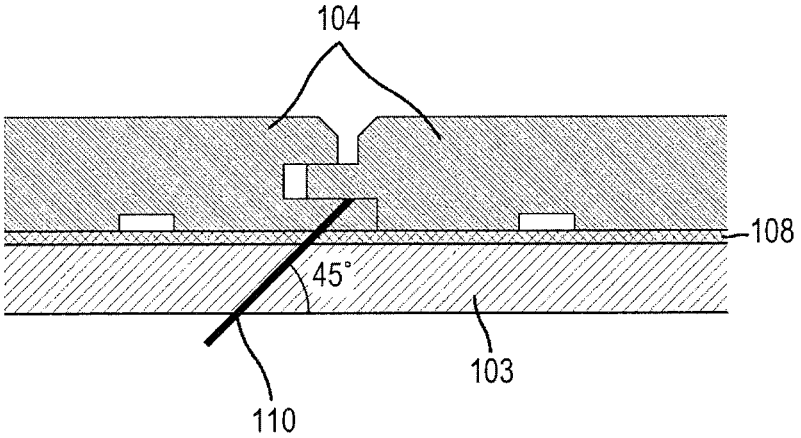
FIG. 4 is a sectional view showing a state in which flooring members are fixed in the construction method according to the example.

The arrangement of flooring members will be described with reference to FIG. 2 to FIG. 4. As shown in FIG. 2, regarding the flooring member, plywood 103 is placed on a floor 101 having a structure according to various construction methods, a charcoal paint 108 is applied thereon and dried, and a plurality of flooring members 104 are then arranged thereon. As shown in FIG. 3, in the flooring members 104, one end 104*a* of long sides is formed in a convex shape and the other end 104*b* paired with the convex shape is formed in a concave shape. Thus, disposition is performed so that convexities and concavities of the ends 104*a* and 104*b* of the plurality of flooring members 104 are aligned. Accordingly, the plurality of flooring members 104 are arranged without being displaced from each other. In this case, as shown in FIG. 4, when a protrusion side of the concave end 104*b* is fixed by a nail 110, it is possible to prevent a displacement on the plywood 103. The nail 110 is preferably at an angle of 45° with respect to the plywood 103. Thereby, it is possible to strengthen a displacement prevention effect. In addition, for a wall 102 having a structure according to various construction methods, a gypsum board 105 is adhered, the charcoal paint 108 is applied thereto and dried, and diatomaceous earth 107 is then applied thereto. In addition, the gypsum board 105 is also applied onto a ceiling surface having a structure according to various construction methods and the charcoal paint 108 is applied thereto twice.

Although description with reference to drawings is omitted, when there is a window sash or a door threshold, a caulking treatment is performed in any gaps. In addition, for example, as shown in FIG. 2 and FIG. 3, in ends of the flooring members 104, at an end that is close to the wall 102, an interval between the wall 102 and the flooring members 104 is preferably set to be about 5 mm using a wedge 107 with a width W of about 5 mm. Thus, the plurality of flooring members 104 can be tightened and fixed. The wedge 107 used in this case is removed 24 hours or longer after installation of the flooring members 104 is completed. Thus, the flooring members 104 can be stabilized. The gypsum board 105 is adhered to the wall 102 and the charcoal paint 108 is applied thereto. Then, a baseboard 106 is attached to the charcoal paint 108 to be in contact with the flooring members 104 in a vertical direction.

Components of Diatomaceous Earth

Diatomaceous earth includes mesopore diatomaceous earth. In addition, the content of mesopore diatomaceous earth of the diatomaceous earth is 90% or more. Mesopore diatomaceous earth is diatomaceous earth having pores with a diameter of 2 to 50 nm and has a strong moisture releasing function and moisture absorbing function depending on environments. Thus, when mesopore diatomaceous earth is used as diatomaceous earth, it is possible to obtain a humidity control effect. In addition, mesopore diatomaceous earth has a strong air freshening function. Thus, when mesopore diatomaceous earth is used as diatomaceous earth, it is possible to obtain an air freshening effect. Specifically, since diatomaceous earth from Hokkaido has pores with a size of 2 to 50 nm, diatomaceous earth from Hokkaido is preferably used.

In addition, diatomaceous earth can include volcanic ash clay, cellulose fibers or starch glue. Volcanic ash clay is used to adjust color. Cellulose fibers are used to prevent cracking after diatomaceous earth is applied. Starch glue is used to improve workability.

Since diatomaceous earth includes only natural materials, it has a stronger humidity control effect than wallpaper of moisture-free vinyl cloth and the like. Thus, it is possible to stay comfortable in the summer even if the usage amount of an air conditioner is reduced. In addition, it is possible to stay comfortable in the winter even if the usage amount of a humidifier is reduced. Thus, an excellent energy saving effect is obtained.

Diatomaceous earth includes only natural materials and includes no chemical substances. Thus, no formaldehyde is released and it is possible to prevent sick building syndrome.

Diatomaceous earth is a material resistant to fire, and diatomaceous earth does not include flammable chemical substances. Therefore, a wall to which diatomaceous earth is applied is resistant to burning and has a flameproof effect.

In vinyl cloth and the like, static electricity is generated, and dust and oil are attracted and contamination easily occurs. On the other hand, since diatomaceous earth includes only natural materials, no static electricity is generated, no dust and oil are attracted, and hardly any contamination occurs. In addition, wallpaper such as vinyl cloth fades in sunlight, and may become detached due to deterioration of glue. On the other hand, diatomaceous earth can be used in a clean state for a long time while being maintenance free without fading due to sunlight and detachment due to deterioration of glue.

Components of Antioxidant Aqueous Solution

The antioxidant aqueous solution includes an ocean mineral component. Specifically, the antioxidant aqueous solution includes at least one of magnesium, calcium, carbon, and silicon. The antioxidant aqueous solution has a deodorizing function, an air cleaning function, a chemical substance removal function, an antibacterial and antifungal function, an antiviral function, a relaxing function and the like.

Method of Spraying Antioxidant Aqueous Solution

The antioxidant aqueous solution is sprayed as particles with a size of 15 to 40 μm. In this case, stainless steel parts, power outlet parts, illumination switch parts and the like are covered with vinyl to prevent failure, short circuiting, electric leakage and the like when the antioxidant aqueous solution is sprayed.

The antioxidant aqueous solution is sprayed twice. In this case, it is necessary to close off a room and leave it alone until indoor mist that has been atomized from an antioxidant aqueous solution when the antioxidant aqueous solution has been sprayed has settled (for example, about 30 minutes). Leaving alone means that the sprayed antioxidant aqueous solution becomes fixed to a floor, a wall, a ceiling and the like. Then, after ventilation, second spraying is performed. In addition, after the second spraying, the space is left for about three days and drying is performed. Thus, it is possible to improve a far infrared effect.

As described above, the space constructed by the construction method according to the example is a comfortable space for residents. Thus, residents can stay comfortably in the room in which such construction is performed and therefore it is possible to obtain a high relaxing effect. In addition, since it is possible to expect improvement in health regarding allergic symptoms such as asthma and atopy, residents can maintain healthy lifestyles. Further, when such construction is performed on a bedroom, residents can obtain effects on sleeping. In addition, when natural materials are used, it is possible to prevent sick building syndrome caused by chemical substances and the like.

For example, when a charcoal paint is applied to a floor, a wall, and a ceiling, it is possible to obtain an air purification effect, a humidity control effect, a deodorizing effect, an antibacterial effect and the like. When humidity is controlled, it is possible to feel comfortable and obtain a mold growing prevention effect.

In addition, when flooring members are arranged on the floor, it is possible to obtain an insulation effect. In addition, according to the softness of the flooring member, it is possible to provide comfort and ensure safety. Furthermore, a termite countermeasure is realized by the resin included in the flooring member.

Further, when diatomaceous earth is applied to a wall, it is possible to obtain a humidity control effect, an air freshening effect, a flameproof effect and the like. In addition, when diatomaceous earth is applied, the wall does not become dirty easily and can be used for a long time without the need for maintenance.

In addition, when the antioxidant aqueous solution is sprayed on the floor, the wall, and the ceiling, it is possible to obtain a deodorant effect, an air cleaning effect, a chemical substance removal effect, an antibacterial and antifungal effect, an antiviral effect, a relaxing effect and the like.

While my construction method has been described with reference to the drawings and examples, it should be noted that various modifications and alternations based on this disclosure can be made easily by those skilled in the art. Therefore, it should be noted that such modifications and alternations are included in the scope of this disclosure. For example, functions and the like included in methods and steps can be rearranged without logical inconsistence and a plurality of methods and steps can be combined into one or can be divided.

The configuration shown in the example and the configuration shown in the reference example may be appropriately combined.

What is claimed is:

1. A construction method comprising:

a charcoal paint application step in which a charcoal paint is applied to at least a ceiling within a construction target room;

an arrangement step in which flooring members made of Obi-sugi are arranged on a floor of the room;

a diatomaceous earth application step in which diatomaceous earth is applied to a wall of the room; and a spraying step in which an antioxidant aqueous solution is sprayed on at least one of the floor that does not include the flooring members arranged thereon, the wall to which the diatomaceous earth is applied and the ceiling to which the charcoal paint is applied.

2. The construction method according to claim 1, wherein the charcoal paint includes red pine tree charcoal.

3. The construction method according to claim 1, wherein the charcoal paint includes two types of red pine tree charcoal burned at different temperatures.

4. The construction method according to claim 1, wherein the charcoal paint further includes at least one of bamboo charcoal, a high carbon ceramic, and an antibacterial agent.

5. The construction method according to claim 4, wherein, when the charcoal paint includes a high carbon ceramic, the high carbon ceramic has a carbon content of 99% or more.

6. The construction method according to claim 4, wherein, when the charcoal paint includes an antibacterial agent, the antibacterial agent is a silver-based inorganic antibacterial agent.

7. The construction method according to claim 1, wherein Obi-sugi of the flooring member has a moisture content of 15% or less.

8. The construction method according to claim 1, wherein the diatomaceous earth includes mesopore diatomaceous earth.

9. The construction method according to claim 8, wherein the content of mesopore diatomaceous earth of the diatomaceous earth is 90% or more.

10. The construction method according to claim 8, wherein the diatomaceous earth further includes at least one of volcanic ash clay, cellulose fibers, and starch glue.

11. The construction method according to claim 1, wherein the antioxidant aqueous solution includes an ocean mineral component.

12. The construction method according to claim 1, wherein the antioxidant aqueous solution includes at least one of magnesium, calcium, carbon, and silicon.

13. The construction method according to claim 1, wherein, in the spraying step, the antioxidant aqueous solution is sprayed as particles with a size of 15 to 40 μm.

14. The construction method according to claim 1, wherein, in the spraying step, the antioxidant aqueous solution is sprayed on the ceiling together with the floor and the wall.

* * * * *